United States Patent [19]

Long et al.

[11] Patent Number: 4,465,966

[45] Date of Patent: Aug. 14, 1984

[54] CONTROLLED FERRORESONANT VOLTAGE REGULATOR PROVIDING IMMUNITY FROM SUSTAINED OSCILLATIONS

[75] Inventors: James F. Long, Elmhurst; Brian J. Budnik, Schaumburg, both of Ill.

[73] Assignee: Motorola, Inc., Schaumburg, Ill.

[21] Appl. No.: 366,111

[22] Filed: Apr. 6, 1982

[51] Int. Cl.[3] ..... G05F 3/06

[52] U.S. Cl. ..... 323/248; 323/326; 361/110; 363/75

[58] Field of Search ..... 363/75, 90; 323/248, 323/306, 307, 235, 319, 326; 307/265, 234, 518; 361/110

[56] References Cited

U.S. PATENT DOCUMENTS

| | | | |
|---|---|---|---|
| Re. 27,916 | 2/1974 | Kakalec . | |
| 3,351,849 | 11/1967 | Mesenhimer . | |
| 3,401,272 | 9/1968 | Rosa et al. . | |
| 3,573,605 | 4/1971 | Hart et al. . | |
| 3,573,606 | 4/1971 | Hart et al. . | |
| 3,596,112 | 7/1971 | Nelson | 323/326 |
| 3,742,257 | 6/1973 | Wittenzellner | 307/265 |
| 3,812,415 | 5/1974 | Van Gilder et al. . | |
| 3,824,449 | 7/1974 | Hase . | |
| 3,916,295 | 10/1975 | Hunter . | |
| 3,965,408 | 6/1976 | Higuchi et al. . | |
| 4,030,025 | 6/1977 | Kakalec . | |
| 4,086,538 | 4/1978 | Foreman | 307/234 |

*Primary Examiner*—William H. Beha, Jr.

*Attorney, Agent, or Firm*—Joan Pennington; Edward R. Roney; James W. Gillman

[57] ABSTRACT

The invention is a controlled ferroresonant power supply with an improved feedback circuit resulting in improved output stability. The feedback circuit is responsive to the low voltage secondary output of the power supply to provide a variable output signal to activate the switch which controls the resonant winding circuit. The improved feedback circuit is responsive to the rectified AC low voltage secondary output for only a portion of its frequency period.

5 Claims, 7 Drawing Figures

CONTROLLED FERRORESONANT VOLTAGE REGULATOR PROVIDING IMMUNITY FROM SUSTAINED OSCILLATIONS

BACKGROUND OF THE INVENTION

This invention relates to ferroresonant power supply circuits and in particular to those with closed feedback loops.

Ferroresonant transformers presently find widespread use in line voltage regulators and DC power supplies. Ferroresonant devices utilize transformer saturation to obtain output voltage regulation over input line voltage changes. Secondary saturation insures that the secondary voltage cannot increase beyond a certain value, independent of variations in primary (input) voltage.

When the voltage level of the AC input to the ferroresonant power supply reaches a certain voltage level, the core under the secondary winding saturates in each AC half cycle. At the point of saturation, the impedence of the saturating transformer (reactor) drops abruptly and capacitive current flows through the low impedence, thus carrying the capacitor charge to the opposite plate of the capacitor. As the capacitor discharges, the saturation flux density in the secondary cannot be sustained, and the reactor snaps out of saturation. At this point almost no capacitive current flows. A new half cycle begins when sufficient volt-seconds are again applied to the reactor to initiate saturation. The energy stored in the capacitor during each half cycle insures that secondary saturation will occur over a wide range of possible loads. Further increases in line voltage beyond the saturation cut-in point are absorbed across the linear inductor. Therefore, the secondary voltage remains constant over changes in line voltage. A more detailed description of ferroresonance and its application to regulated power supplies can be found in Transformer and Inductor Design Handbook, William T. McLyman, Marcel Dekker, Inc. (1978) which is incorporated by reference, as if fully set forth herein.

Standard ferroresonant power supplies utilize core saturation to achieve line regulation. However, since the core is the regulating element, it cannot regulate against influences external to the core such as frequency changes and losses in external wiring. Ferroresonant power supplies can be improved to regulate against frequency and load changes by adding a feedback control circuit to the ferroresonant transformer. According to one such improvement, the transformer core is never allowed to saturate. Instead, an AC switch connects an inductor in parallel with the AC capacitor to provide a low impedence discharge path for the capacitor. By closing the AC switch for a fraction of each half cycle, a ferroresonant discharge is simulated and the output voltage in the secondary winding can be varied as necessary with a feedback loop. This arrangement is commonly referred to as a controlled ferroresonant power supply. This improvement, however, results in increased loop gain and potentially unstable conditions at certain frequencies. Input AC line transients and rapidly changing load conditions can easily trigger sustained oscillations.

Prior art teaches that loading down the output of the ferroresonant power supply enhances stability by reducing the likelihood of sustained oscillation. Such a solution to the instability problem is unsatisfactory since part of the total available output power of the power supply must be dissipated to provide stability. As much as 10% of the available output may be required to insure the power supply will not oscillate. When this reduction of available output power has been found unacceptable the alternative in the prior art has been to monitor the output voltage from the ferroresonant power supply with a control circuit to sense output instability. When oscillations occur, the control circuit may "crowbar" or shutdown the power supply. This solution is also inadequate since it may result in the untimely shutdown of the power supply. Moreover, crowbarring or shutting down the ferroresonant power supply is not a solution to the problem, but only a safeguard mechanism to protect other equipment from damage caused by the instability of the ferroresonant power supply. Therefore, there is a need for a controlled ferroresonant power supply which can be operated stably over a no load to full load range without requiring the dissipation of power supply output power or the shutting down of the power supply.

An object of this invention is to provide a new and improved construction of a controlled ferroresonant power supply which maintains operational stability over input line transients and rapid variations in output load.

A further object of this invention is to provide a controlled ferroresonant power supply which permits stable operation with no external load.

SUMMARY OF THE INVENTION

Briefly the invention is a controlled ferroresonant power supply with an improved feedback circuit resulting in improved output stability. The controlled ferroresonant power supply of the invention includes a transformer, a low voltage secondary, a switch, a feedback circuit and a resonant winding circuit. The feedback circuit is responsive to the low voltage secondary output to provide a variable output signal to activate the switch. The resonant winding circuit changes the magnetic characteristics of the transformer core in response to the activation of the switch. The improved feedback circuit is responsive to the low voltage secondary output for only a portion of the frequency period of the AC signal input to the ferroresonant power supply. The feedback circuit includes a synchronizer circuit and clock responsive to the low voltage secondary output, a timing circuit responsive to the clock and an output means responsive to the timing circuit. The timing circuit supplies a signal to an inhibit input of the clock in a time frame such that the clock (and thus the feedback circuit) is only activated for a small time window during each half cycle of the AC input to the ferroresonant power supply.

DESCRIPTION OF THE PREFERRED EMBODIMENT

Figure 1:
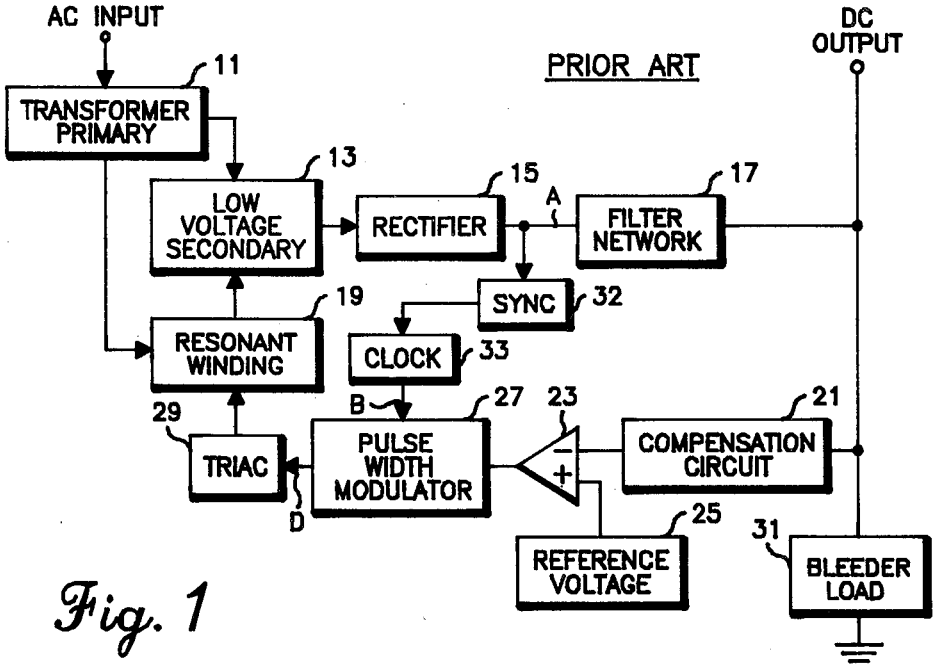
FIG. 1 is a block diagram of a prior art closed loop ferroresonant D.C. power supply.

FIG. 1 shows a prior art diagram of the basic controlled ferroresonant power supply for which the invention is intended. A fixed frequency AC input signal is supplied to transformer primary winding 11 which is magnetically linked to a low voltage secondary 13 and a high voltage resonant winding 19 by transformer action. The resonant winding 19 consists of a winding wound about the saturating transformer core and a capacitor in parallel with the winding. The capacitor is commonly referred to as a resonating capacitor and together with the saturating transformer is responsible for the characteristic voltage dependent resonance of the transformer. The low voltage secondary consists of a winding wound about the saturating transformer core. The output of the low voltage secondary 13 is received by a full wave rectifier 15. The rectified AC voltage from rectifier 15 is supplied to filter network 17 which conventionally has a capacitive input. The output of filter network 17 produces a low ripple DC voltage. The resonant winding 19 also includes an external linear inductor. A feedback circuit supplies the required control signals to cause the linear inductor to appear in parallel with the high voltage resonant winding during a portion of each half cycle thereby simulating saturation in the transformer core.

In FIG. 1 the compensation circuit 21 serves to provide adequate gain and phase margin near the switching frequency of triac 29. The error amplifier 23 compares the output voltage of the power supply with a predetermined reference voltage 25. The output of the error amplifier 23 is a DC voltage representing the given error between the present DC output voltage and the reference voltage. The pulse width modulator 27 uses the DC voltage level from the error amplifier 23 and the output from a clock 33 to generate a pulse width modulated signal which turns triac 29 on and off. The triac 29 acts as a switch to electrically connect the linear inductor in shunt with the resonant winding 19. A synchronizer circuit 32 receives the output from rectifier 15. The synchronizer circuit 32 reduces the voltage magnitude of the signal from rectifier 15 so that it is compatable with the input to clock 33. The clock 33 is preferably a zero-crossing detector clock. The exact configuration and interrelationship of the resonant winding 19, the triac 29, and the low voltage secondary 13 are well known to those of ordinary skill in the art of ferroresonant voltage regulators and will not be dealt with in detail herein.

A bleeder load 31 is a minimum load appearing across the DC output of the controlled ferroresonant voltage regulator of FIG. 1. The bleeder load 31 can be a simple device such as a high wattage resistor. The purpose of the bleeder load 31 is to maintain stable operation in the feedback loop of the controlled ferroresonant power supply of FIG. 1 under no load or light load conditions. The bleeder load 31 also acts to stablize the controlled ferroresonant power supply under certain input transient conditions. The most troublesome of those being periodic AC line interrupts and rapid changes in loading.

Figure 2:
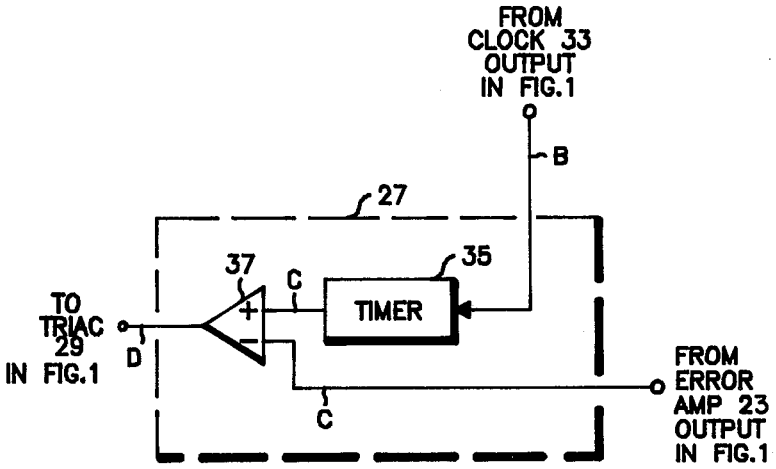
PRIOR ART Fig. 2
FIG. 2 is a circuit diagram of the FIG. 1 prior art pulse width modulator.
Figure 3:
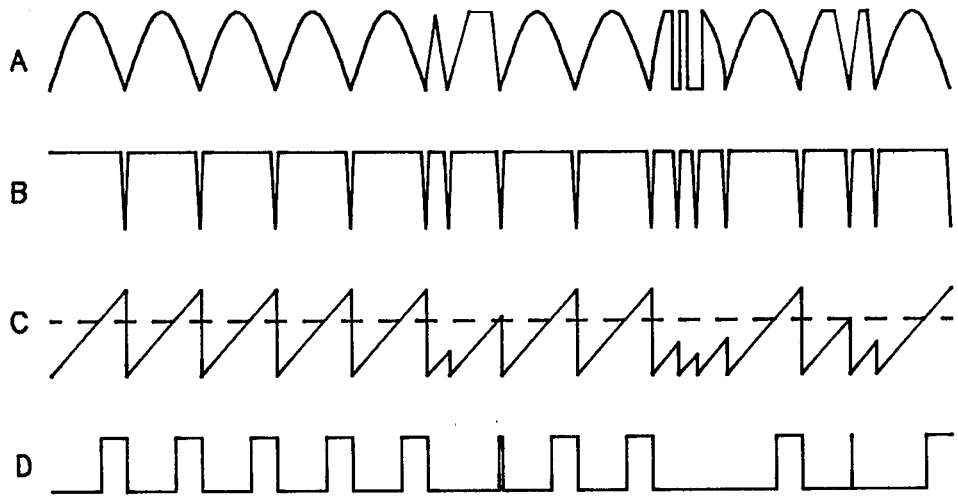
FIG. 3 is a waveform timing diagram of various signals associated with the circuit diagram of FIG. 2.

FIGS. 2 and 3 are respectively a schematic diagram showing the component building blocks of the pulse width modulator 27 of FIG. 1 and a waveform timing diagram of the input and output signals associated with FIGS. 1 and 2. FIG. 2 shows the pulse width modulator 27 comprising a timer 35 and a comparator 37. Waveform A of FIG. 3 shows the signal A from the rectifier 15 output which provides the input signal to the synchronizer circuit 32. Waveform B is the output of zero-crossing detector clock 33. The clock 33 output B is used as a timing input to timer 35 of pulse width modulator 27. Timer 35 can be a simple RC network with its charging and discharging synchronized with the output signal of clock 33. The output of timer 35 is a ramp voltage represented by waveform C in FIG. 3. The timer 35 generates a ramp voltage output which is discharged in each half-cycle when the clock 33 output voltage falls below a predetermined threshold.

In FIG. 3 the ramp voltage portion of waveform C is the output of timer 35 which is delivered to the positive input of comparator 37 while the DC voltage from the error amplifier output is delivered to the negative input of comparator 37, shown as the dashed line in waveform C. The output of comparator 37 is shown in waveform D of FIG. 3. The output is a pulse width modulated waveform which serves to turn the triac 29 on and off (symbolically shown in FIG. 1). The particular design for the clock 33 and the timer 35 are all well known and conventional designs. Comparator 37 can be constructed of a conventional operational amplifier in a well known manner, but any appropriate pulse width modulator technique can be used.

As the magnitude of the D.C. voltage from error amplifier 23 varies, the duty cycle of the output of comparator 37 will vary correspondingly. Accordingly, by changing the duty cyle of the output from comparator 37 (waveform D in FIG. 3) the triac 29 firing is modified, thus varying the time of simulated saturation for the transformer core. Through transformer action the low voltage secondary 13 can be controlled. This can be quite easily seen by an examination of waveforms C and D in FIG. 3. As the ramp voltage from the timer 35 rises, it reaches a point where it becomes greater than the DC voltage from error amplifier 23 (this DC voltage is shown by a dotted line in waveform C of FIG. 3). At that point, the comparator 37 switches from a low to high state. When the ramp voltage discharges the comparator 37 changes from a high to low state since now the DC error voltage is greater than the ramp voltage appearing at the positive input of comparator 37.

A change in voltage at the DC output of the ferroresonant power supply will result in a control feedback signal which will cause the triac 29 firing time to change and thus maintain the DC output at its desired voltage. As noted earlier without a bleeder load 31, a ferroresonant power supply both with and without feedback control circuitry is susceptible to unstable operation when operated under a light, no load or transient load conditions and also when subjected to primary line voltage interrupts. Loading the ferroresonant power supply with a bleeder circuit causes up to 10% or more of the total deliverable power to be lost or sacrificed in order to maintain stability under all normal operating conditions. Since this seriously effects the efficiency of the ferroresonant power supply and also increases the cost of its operation and manufacture, there is a need to stablize the controlled ferroresonant power supply by some means other than bleeding off some of the available output power.

Figure 4:
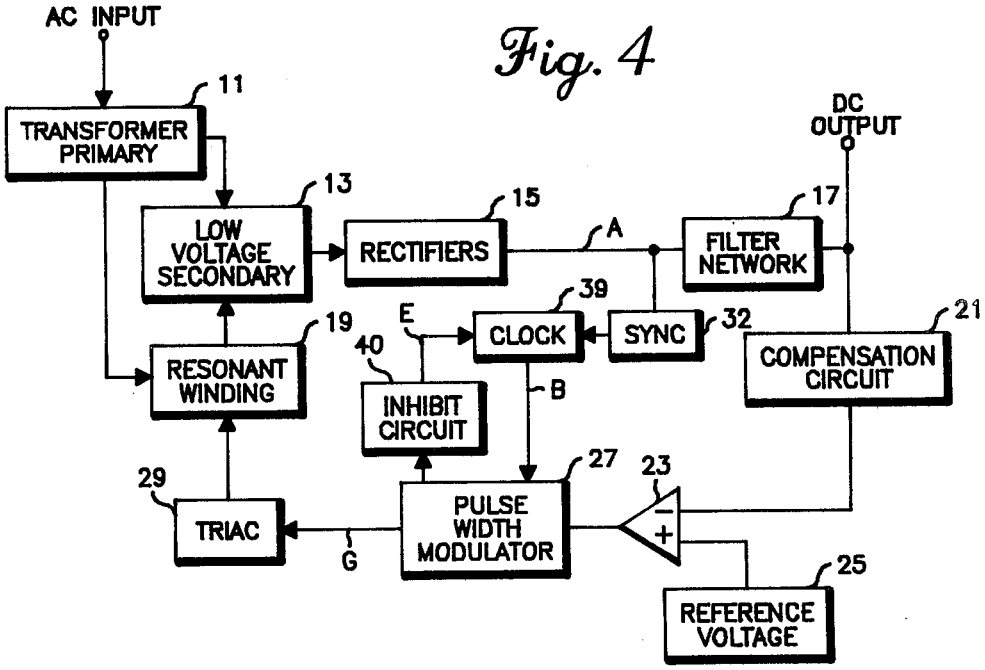
FIG. 4 is a block diagram of a controlled ferroresonant power supply according to the invention.

FIG. 4 is a block diagram of the closed loop ferroresonant power supply according to the invention. Except for clock 33 in FIG. 1 each component block of the FIG. 4 block diagram of the invention is functionally the same as the component blocks of the FIG. 1 prior art controlled ferroresonant power supply. Therefore each component block in FIG. 4 is numbered the same as its counterpart in FIG. 1 with the single exception of the clock block. By modifying the operation of the clock block in FIG. 1, the invention eliminates the need for the bleeder load block 31 shown in FIG. 1.

The clock 39 in FIG. 4 has an inhibit function which responds to a control signal from an inhibit circuit 40. The inhibit circuit 40 only allows the clock 39 to respond to synchronizing pulses from synchronizer circuit 32 during a small time interval which is proximate in time to an expected synchronizing pulse from synchronizer 32. Thus, the ferroresonant power supply according to the invention achieves its high stability by rejecting all false synchronizing pulses from synchronizer circuit 32, allowing only properly spaced synchronization pulses to be recognized by the clock 39. Accordingly the closed loop ferroresonant power supply of FIG. 4 does not require a minimum load and corresponding power dissipation to be maintained on the power supply output. By eliminating this bleeder load, the ferroresonant power supply of the invention is free to deliver all of its available power to its output load. This effectively results in a substantial increase in operational efficiency and thus a substantial reduction in operational cost for the controlled ferroresonant power supply of the invention.

The controlled ferroresonant power supply of FIG. 4 is composed of five primary building blocks. The first is the input circuit composed of transformer primary 11 and a AC input signal. The second is the secondary which includes the low voltage secondary 13, the rectifier 15 and the filter network 17. The third primary building block is the feedback network composed of the compensation circuit 21, error amplifier 23, reference voltage 25, synchronizer 32, clock 39, pulse width modulator 27 and inhibit circuit 40. The fourth building block is a switch composed of triac 29. And the fifth building block is the magnetic flux control composed of the resonant winding 19.

Figure 5:
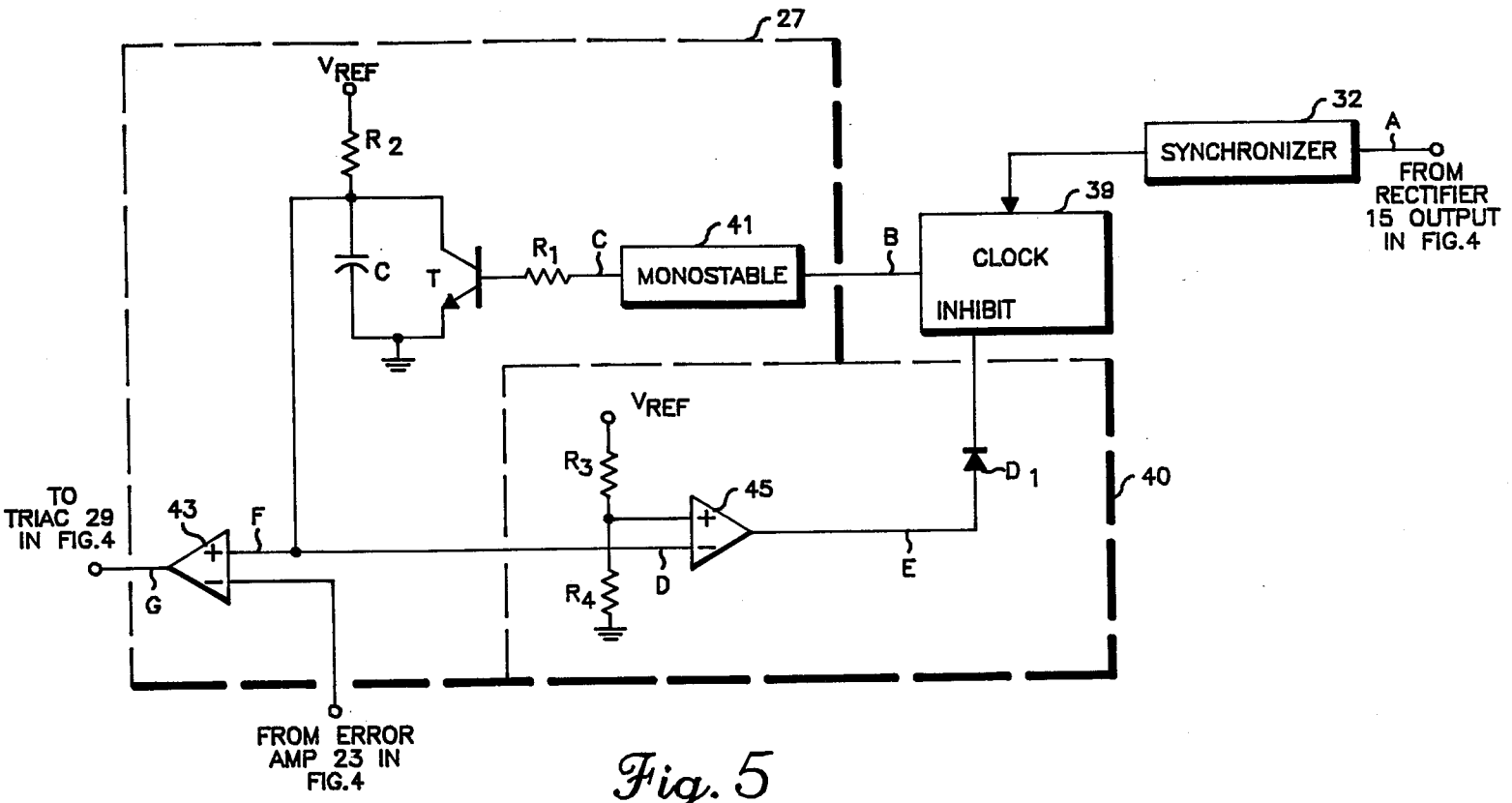
FIG. 5 is a circuit diagram of a portion of the feedback circuit for a controlled ferroresonant power supply according to the invention.

FIG. 5 is a circuit diagram of a portion of the feedback circuit of the ferroresonant power supply of FIG. 4. The dotted line blocks define pulse width modulator 27 and inhibit circuit 40 from FIG. 4. Clock 39 in FIG. 5 may be a zero-crossing detector clock which switches to a low state upon detection of zero-crossing at its input. With the exception of an inhibit input the clock 39 is similar to the clock 33 in the prior art FIG. 2 and of well known construction to those of ordinary skill in the art. The output of the clock 39 in FIG. 5 provides the input to a monostable 41 which is also of conventional construction. In the preferred embodiment of the invention the monostable is constructed from operational amplifiers in a manner well known to those of ordinary skill in the art.

Pulse width modulator 27 includes the timing network of monostable 41, capacitor discharge transistor T, capacitor C and resistor R2 with a characteristic charging rate defined by CR2. The CR2 network is charged through a voltage $V_{REF}$. The pulse output of the monostable 41 is delivered to the base of a capacitor discharge transistor T by way of resistor R1. The pulse from monostable 41 turns on the transistor T which results in the discharge of any voltage appearing across the capacitor C. Both cathode of capacitor C and the emitter of transistor T are connected to ground. The collector of transistor T is connected to the anode of capacitor C and the first end of resistor R2. The second end of resistor R2 is connected to $V_{REF}$. The signal at the anode of capacitor C serves as an input signal to comparator 43 and comparator 45. A reference voltage is provided to the positive input of comparator 45 by voltage divider network R3 and R4. The negative input of comparator 45 receives the voltage from the anode of capacitor C. The output of comparator 45 is delivered to the inhibit input of clock 39 by way of protection diode D1. Both comparator 43 and comparator 45 are conventional comparators and are preferrably constructed from operational amplifiers. The comparator 43 is part of the pulse width modulator 27 in FIG. 4 and has as its positive input the voltage on the anode of capacitor C and at its negative input the variable DC voltage from error amplifier 23. The output of comparator 43 is a pulse width modulated signal which is used as a control signal for the triac 29 shown in FIG. 4.

Figure 6A:
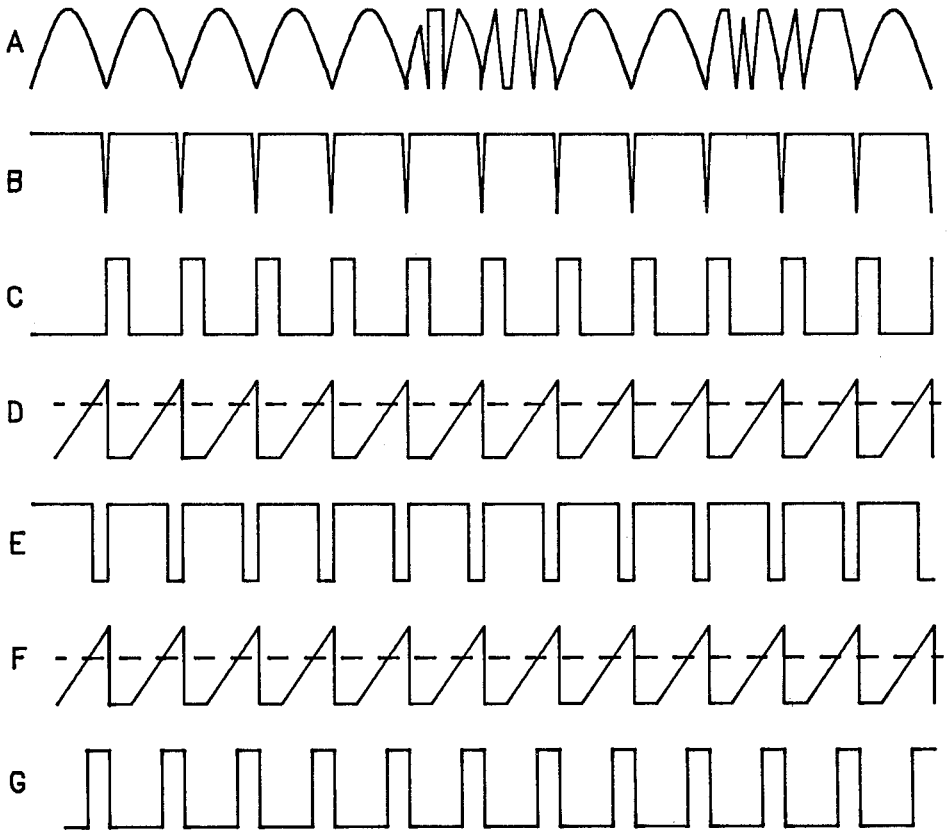
FIG. 6*a* is a waveform timing diagram of various significant signals associated with the pulse width modulator shown in FIG. 5.
Figure 6B:
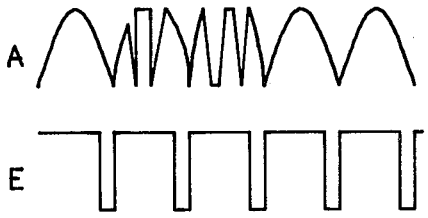
FIG. 6*b* is a comparison diagram between two waveforms in FIG. 6*a*, the first of which represents the input signal to the feedback circuit of the ferroresonant power supply shown in FIG. 5 and the second of which represents the signal defining the time window during which the FIG. 5 feedback circuit is activated.

FIGS. 6A and 6B show a waveform associated with the operation of the invention shown in FIG. 5. The waveforms A-G of FIG. 6A appear at different inputs and outputs of the circuit components shown in FIG. 5. Waveform A is the output from rectifier 15. Waveform A is a full wave rectified signal of the AC input to the transformer primary 11. Waveform A supplies an input signal to clock 39 in FIG. 5. Waveform B is the output signal from the clock 39 in FIG. 5 which serves as the input signal to monostable 41 of FIG. 5. The output of monostable 41 is waveform C. Waveform C is applied to the base of capacitor discharge transistor T in FIG. 5 and enables the ramp in waveforms D and F. Waveform D in FIG. 6A shows the two voltages applied to comparator 45 in FIG. 5. The first voltage is a ramp voltage created by $V_{REF}$, resistor R and capacitor C in response to waveform C signal from monostable 41. The second signal is a steady DC reference voltage created by voltage divider network R3–R4. When the ramp input voltage applied to comparator 45 becomes greater than the reference DC voltage, the output waveform E of comparator 45 will change from a positive to a negative state. This can be seen by comparing waveform E with waveform D.

The waveform F in FIG. 6A shows the two voltage signals at the inputs to comparator 43. The ramp voltage is input to the positive input of the comparator 43. The negative input of the comparator 43 is supplied by a variable DC voltage from the error amplifier 23 (shown in FIG. 4). As can be seen, the comparator output shown as waveform G in FIG. 6A flips from a low to high state when the ramp input to comparator 43 becomes greater than the variable DC input from error amplifier 23.

Waveform A of FIG. 6A has several transient pulses present at the output of rectifier 15. The transient pulses can appear in response to line interrupts or load transients to the power supply. As can be seen by comparing FIG. 6A with FIG. 3, the input waveform A is identical for both the prior art circuit in FIGS. 1 and 2 and the circuit according to the invention shown in FIGS. 4 and 5. The transients in waveform A produce an undesirable effect in the prior art pulse width modulator output as can be seen in waveform D of FIG. 3. This instability results because the pulses from synchronizer 32 to prior art clock 33 in FIG. 2 become erratic when the ferroresonant transformer begins to oscillate. These erratic pulses cause the feedback circuit to respond out of step, thus locking the entire power supply into a sustained uncontrollable oscillation.

Waveform E in FIG. 6A provides an inhibit signal to the clock 39 in FIG. 5. The inhibit pulses prevent the clock 39 from responding to false zero-crossing detections caused by transients. The duty cycle of the square wave in waveform E of FIG. 6A is determined by the DC voltage level of the reference voltage input at the positive input of comparator 45. This can be easily visualized by an examination of waveform D in FIG. 6A. Since waveform E only releases the clock 39 in FIG. 5 from an inhibit condition for a short period of time in one cycle of the rectified AC output from rectifier 15, then that short period of inhibit release provides a time window in which the input to the clock 39 is sensitive to its input signal (waveform A). Accordingly the clock 39 is not sensitive to all of the transients on waveform A. In fact, with the duty cycle of waveform E high enough, the circuit of FIG. 5 can become virtually immune from any effect from input transients on its pulse width modulated output applied to triac 29.

FIG. 6B shows waveform A and waveform E in close comparison to better illustrate the time window in which the clock 39 is enabled to examine its input voltage from the rectifier 15. The timing circuit removes the inhibit signal from the inhibit input of the clock 39 for only a small period of time in the proximity of the expected zero-crossing of the rectified AC signal. Transient zero-crossings occurring during the time interval between zero-crossings caused by transformer oscillation are ignored by the feedback circuit since the clock 39 is in an inhibit state for all but a small portion of the period of the rectified secondary voltage. The charging time of the ramp voltage and the setting of the reference voltage into the comparator 45 is adjusted such that the inhibit input to clock 39 is released only for a desired interval that is proximate in time to the next expected zero-crossing caused by a normal input signal.

In summary, the feedback circuit through the timing circuit, clock 39 and its inhibit input act to sample the output of the power supply at periodic time windows that correspond to expected zero-crossings of the power supply output.

We claim:

1. A ferroresonant power supply operating from AC input signal to provide a regulated output, said power supply comprising:

a secondary including a transformer core for receiving said AC input signal by transformer action and for developing an output, switching means, a feedback circuit including a clock and an output means, said clock being enabled to respond to said secondary output for only a portion of the frequency period proximate the expected zero-crossings of said AC signal and otherwise disabled and said output means being responsive to said clock for providing a variable output signal to activate said switching means, and resonant winding means which changes the magnetic characteristics of said transformer core in response to said switching means.

2. A ferroresonant power supply operating from an AC input signal to provide a regulated output, said power supply comprising:

a secondary including a transformer core for receiving said AC input signal by transformer action, switching means, a feedback circuit enabled to respond to said secondary output for only a portion of the frequency period of said AC signal and providing a variable output signal to activate said switching means, said feedback circuit including a clock responsive to said secondary output and having an inhibit input, a timing circuit responsive to said clock, an inhibit circuit responsive to said timing circuit to disable and enable said inhibit input of said clock, output means responsive to said timing circuit to provide a variable signal output to said switching means, and resonant winding means which changes the magnetic characteristics of said transformer core in response to said switching means.

3. A ferroresonant power supply according to claim 2 wherein said timing circuit includes, a monostable circuit responsive to said clock, a voltage charging network responsive to said monostable circuit.

4. A ferroresonant power supply according to claim 2 wherein said output includes, an error amplifier responsive to said secondary output, a comparator circuit responsive to said error amplifier and said timing circuit to provide a pulse width modulated output signal to said switching means.

5. A ferroresonant power supply according to claim 2 wherein said inhibit circuit includes, a voltage reference circuit, a comparator circuit responsive to said timing circuit and said voltage reference circuit to provide said inhibit input of said clock with signals which enable said clock during the proximate time of expected zero-crossing of normal secondary output signals while holding said clock disabled at all other times.

* * * * *